US007356274B2

(12) United States Patent
Watanabe

(10) Patent No.: US 7,356,274 B2
(45) Date of Patent: Apr. 8, 2008

(54) METHOD AND APPARATUS FOR FORMING A COLOR IMAGE BY SUPERPOSING COLOR TONER IMAGES WITH AN INTERMEDIATE TRANSFER MEDIUM

(75) Inventor: Fumiyuki Watanabe, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/496,577

(22) Filed: Aug. 1, 2006

(65) Prior Publication Data

US 2006/0269338 A1 Nov. 30, 2006

Related U.S. Application Data

(63) Continuation of application No. 11/177,301, filed on Jul. 11, 2005, now abandoned, which is a continuation of application No. 10/880,590, filed on Jul. 1, 2004, now Pat. No. 6,925,270, which is a continuation of application No. 10/331,979, filed on Dec. 31, 2002, now Pat. No. 6,813,453.

(51) Int. Cl.
*G03G 15/16* (2006.01)

(52) U.S. Cl. ..... 399/66; 358/1.17; 399/76; 399/302

(58) Field of Classification Search ..... 399/302, 399/298, 66, 76, 82, 38; 358/1.16, 1.17
See application file for complete search history.

(56) References Cited

U.S. PATENT DOCUMENTS

| | | | | |
|---|---|---|---|---|
| 5,926,670 | A | 7/1999 | Furuta et al. | |
| 5,930,571 | A * | 7/1999 | Ito | 399/302 |
| 5,970,278 | A | 10/1999 | Munakata | |
| 6,253,039 | B1 | 6/2001 | Nakano et al. | |
| 6,266,497 | B1 * | 7/2001 | Maekawa | 358/1.17 X |
| 2004/0126128 | A1 | 7/2004 | Shibata | |

FOREIGN PATENT DOCUMENTS

| | | | |
|---|---|---|---|
| JP | 10-322525 | A | 4/1998 |
| JP | 11-311931 | A | 11/1999 |
| JP | 2000-035706 | A | 2/2000 |

* cited by examiner

*Primary Examiner*—Sophia S. Chen
(74) *Attorney, Agent, or Firm*—Foley & Lardner LLP

(57) ABSTRACT

In the present invention, in an image forming apparatus for laminating images by using an intermediate transferring body, it is sensed that all toner images corresponding to image data for the same sheet material are formed on the intermediate transferring body in an arbitrary order, and the toner images are transferred onto the sheet material, regardless of the colors of the toner images held by the toner image holding section. Therefore, number of sheets output per unit time can be increased.

5 Claims, 3 Drawing Sheets

METHOD AND APPARATUS FOR FORMING A COLOR IMAGE BY SUPERPOSING COLOR TONER IMAGES WITH AN INTERMEDIATE TRANSFER MEDIUM

The present application is a continuation of U.S. application Ser. No. 11/177,301, filed Jul. 11, 2005 (now abandoned), which is a continuation of U.S. application Ser. No. 10/880,590, filed Jul. 1, 2004 (now U.S. Pat. No. 6,925,270), which is a continuation of U.S. application Ser. No. 10/331,979, filed Dec. 31, 2002 (now U.S. Pat. No. 6,813,453), the entire contents of which are incorporated herein by reference.

BACKGROUND OF THE INVENTION

The present invention relates to an image forming apparatus forming an image on an output medium, and to an image outputting method.

In an image forming apparatus which can output a color image by overlapping monochrome images by using an intermediate transfer medium, an effective image holding length which can hold images corresponding to the largest output medium which can be outputted is given to the intermediate transfer medium. Namely, when the intermediate transfer medium is cylindrical, the circumference thereof is defined to be able to hold the aforementioned largest image, and when the intermediate transfer medium is belt-shaped, the overall length thereof is defined to be able to hold the aforementioned largest image.

Therefore, in an image forming apparatus in which an intermediate transfer medium, to which a length corresponding to the long side of an A3 sized paper is given as the effective image holding length of the intermediate transfer medium, is built in, due to an A4 sized paper being conveyed such that the direction perpendicular to the direction of conveying the paper is the long side direction of the (A4) paper (hereinafter, simply called A4 portrait), a method for simultaneously outputting images of two A4 portrait on the intermediate medium has been put into practice.

Incidentally, when images of two A4 portrait are simultaneously outputted on the intermediate transfer medium, there is the problem that the images cannot be outputted until the image data for two A4 portrait (for two pages) of all of the monochrome images which can be overlapped on the intermediate transfer medium is obtained.

Namely, the compiling time required for compiling image data into output-image data varies, according to the complexity of the data, such as the density and size of the image data per page. Therefore, in an image outputting method in which toner images corresponding to output-image data are sequentially transferred onto an intermediate transfer medium, because the image forming operation starts at the point in time when the total output-image data of the monochrome images which can be overlapped on the intermediate transfer medium has been obtained, there is the problem that the number of image formations (number of outputs) per unit time is small.

BRIEF SUMMARY OF THE INVENTION

An object of the present invention is to provide an image forming apparatus and an image outputting method which can improve the number of image outputs per unit time in an image forming apparatus overlapping images by using an intermediate transfer medium.

According to a first aspect of the present invention, there is provided an image forming apparatus comprising:

an output-image data holding section which holds image data for image output used for forming a toner image;

an image forming section which can hold an electrostatic image that is the basis of the toner image corresponding to the image data;

an electrostatic image developing section which supplies toner to the electrostatic image formed at the image forming section so as to make the electrostatic image visible, and which forms a toner image;

a toner image holding section which holds the toner image formed at the electrostatic image developing section, the toner image holding section being capable of holding two or more toner images in a superposed state, having an effective image holding region of a predetermined size, and being capable of holding toner images for different transfer media in the effective image holding region;

a transfer outputting section which transfers onto a transfer medium the toner image which the toner image holding section holds;

a transfer control section which supplies the transfer medium at a transfer position at which the toner image can be transferred onto the transfer medium between the toner image holding section and the transferring outputting section, when it is informed from a page managing section that at least one toner image, for the transfer medium, which the toner image holding section holds, can be transferred onto the transfer medium; and a page managing section which senses that the total image data for one transfer medium is inputted, and informs the transfer control section that the output for the transfer medium which the toner image holding section holds can be transferred onto the transfer medium, when the image data corresponding to the toner image for the different transfer medium and the image data for the same transfer medium is inputted in a predetermined order.

According to another aspect of the present invention, there is provided an image forming method comprising:

being able to hold a toner image corresponding to output picture image data of two pages in a range of an effective image holding length when it is sensed that inputted image data is less than ½ of the effective image holding length of the intermediate transfer medium, and being able to set a "dividing outputting mode" which transfers toner images in units of one page onto an output medium at a point in time when output-image data of one page is stored in an image memory;

after compiling image data inputted to an output-image data holding section into output-image data, storing the output-image data in the output-image data holding section;

holding, in a storing section, the amount of the output-image data supplied to the output-image data holding section and page information of individual image data such that pages and colors of toner images correspond, by setting the "dual outputting mode";

preparing a transfer medium so as to be able to convey the transfer medium to a transfer position on the basis of the held page information at a predetermined timing after first image data is inputted into the output-image data holding section; and transferring onto the transfer medium an output image of a page on which a predetermined number of toner images have already been superposed, at a point in time when it is sensed that a predetermined amount of output-image data per one page which enables transfer of an image to be outputted onto the transfer medium has been stored in the output-image data holding section, on the basis of the page information held in the storing section.

According to still another aspect of the present invention, there is provided an image forming apparatus which overlaps toner images of a predetermined number of colors by using an intermediate transfer medium, and which obtains a color image output by collectively transferring the toner images onto a transfer medium, comprising:

an image forming section which can hold an electrostatic image that is the basis of the toner image corresponding to the image data;

an electrostatic image developing section which supplies toner to the electrostatic image formed at the image forming section so as to make the electrostatic image visible, and which forms a toner image;

a toner image holding section which holds the toner image formed at the electrostatic image developing section, the toner image holding section being capable of holding two or more toner images in a superposed state, having an effective image holding region of a predetermined size, and being capable of holding toner images for different transfer media in the effective image holding region;

a transfer outputting section which transfers onto a transfer medium the toner image which the toner image holding section holds;

a transfer control section which supplies the transfer medium at a transfer position at which the toner image can be transferred onto the transfer medium between the toner image holding section and the transferring outputting section, when it is informed from the page managing section that at least one toner image, for the transfer medium, which the toner image holding section holds, can be transferred onto the transfer medium; and a page managing section which senses that all of the toner images corresponding to the image data for the same transfer medium are stored in the toner image holding section, and transfers onto the transfer medium output for the transfer medium which the toner image holding section holds, regardless of the colors of the toner images held by the toner image holding section.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Hereinafter, one example of operations of an image forming apparatus to which an embodiment of the present invention can be applied will be described with reference to the drawings.

Figure 1:
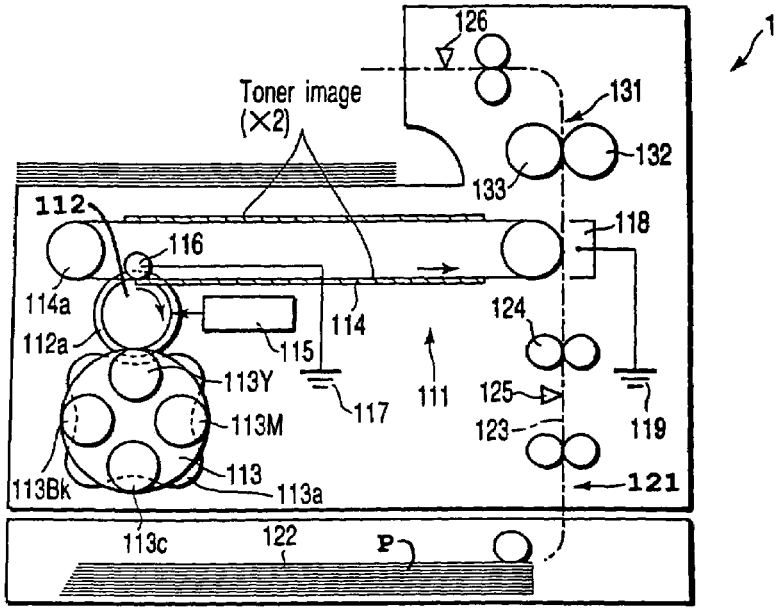
FIG. 1 is a schematic diagram for explanation of one example of an image forming apparatus to which an embodiment of the present invention can be applied.

FIG. 1 is a schematic diagram for explanation of one example of a printer apparatus which is one example of the image forming apparatus and which can output an image onto an output medium, for example, paper.

As shown in FIG. 1, a printer apparatus 1 has a process unit 111, a medium (paper) conveying system 121, and a fixing device 131, and the like.

The process unit 111 includes a photosensitive member 112 which can hold a latent image corresponding to image information to be outputted, i.e., image data, a developing device 113 forming a toner image by carrying out development by selectively supplying toner on the latent image which the photosensitive member 112 holds, a transfer belt 114 which temporarily holds the toner image formed by the developing device 113 and which conveys the toner image such that the toner image can be transferred onto an output medium, which is a predetermined sized paper or a resin sheet, and an exposing device 115 forming a latent image on the photosensitive member 112, and the like.

The image data is supplied from a data supplying section such as, a host computer PC or the like.

Further, the process unit 111 may be any of various types of image preparing (image forming) system which can be used for well known printer apparatuses, for example, a thermal transfer system, an inkjet system, and the like.

A first transfer device 116, which sequentially transfers (attracts) the toner images formed on the photosensitive member 112 onto the transfer belt 114, is provided at a toner image overlapping position facing the photosensitive member 112 with the transfer belt 114 being disposed therebetween.

A first power-supply unit 117 which can output a transfer voltage of a predetermined magnitude is connected to the first transfer device 116.

A second transfer device 118, which transfers the toner images onto an output medium conveyed and supplied through a paper conveying system 121, i.e., a paper or a resin sheet from the transfer belt 114, is provided at a transfer position at which the transfer belt 114 and the paper conveying system 121 are adjacent to (face) one another.

A second power-supply unit 119 which can output a transfer voltage of a predetermined magnitude is connected to the second transfer device 118.

The developing device 113 is a revolver type developing device in which first to fourth developing sections 113Y (Yellow), 113M (Magenta), 113C (Cyan), and 113Bk (Black), which can provide monochrome images of four colors which are color-separated in order to output a color image based on subtractive primaries, are integrally formed.

The respective monochrome developing sections 113 (Y, M, C, and Bk) are formed so as to be rotatable around a rotation shaft which is not described in detail, and selectively supply predetermined color toners onto the latent image formed on the photosensitive member 112 by being positioned at a position facing the photosensitive member 112. The fourth developing section 113Bk develops a block image and a black image by superposing the three toner images of the first to third developing sections 113Y, 113M, 113C.

In the developing device 113, in order to exchange the toners for sequentially developing by the four color toners the latent image formed on the photosensitive member 112, namely, in order to replace the first to fourth developing sections 113Y, 113M, 113C, and 113Bk which face the photosensitive member 112, the distance between the developing device 113 and the photosensitive member 112 is made large at a predetermined timing by, for example, a slider 112*a* and a cam mechanism 113*a*.

The distance between the photosensitive member 112 and the developing device 113 is maintained so as to be constant during an effective image holding length of the transfer belt 114 which will be described hereinafter, i.e., while the transfer belt 114 travels around once.

As the effective image holding length, at least a length corresponding to the long side of an A3 sized paper is given to the transfer belt 114. Accordingly, when an A4 sized paper is conveyed such that the direction perpendicular to the direction of conveying the paper is the long side direction of the (A4) paper (hereinafter, simply called A4 portrait), images of two A4 portrait can be simultaneously held on the transfer belt 114.

The transfer belt 114 is a resin belt having a predetermined thickness, for example, an endless belt in which an optical semiconductor thin layer (photosensitive layer) is formed on one side of a polyester film and which has no seam.

The paper conveying system 121 includes a paper cassette 122 which can accommodate media for holding output images, i.e., an arbitrary number of papers, a conveying path (path) 123 guiding a paper P conveyed between the paper cassette 122 and the process unit 111 and between the process unit 111 and the fixing device 131, and aligning rollers 124 eliminating the skew of the paper P conveyed through the conveying path 123, and the like. Note that the path 123 includes a plurality of sensors, for example, an aligning sensor 125 and a fixing/discharging sensor 126, which can sense paper jamming in which the paper P conveyed through the path 123 gets stuck at an arbitrary position of the path 123.

The fixing device 131 includes a first roller 132 whose temperature can be raised to a predetermined temperature, and a second roller 133 which can provide a predetermined pressure to the first roller 132.

The fixing device 131 melts the toner electrostatically adhered to a paper due to the paper passing through between the both rollers, and fixes the toner on the paper by pressuring the paper.

In many cases, the fixing device includes a heater (not shown) which is integrally provided at the first roller 132 and heats the first roller 132 to a predetermined temperature.

Figure 2:
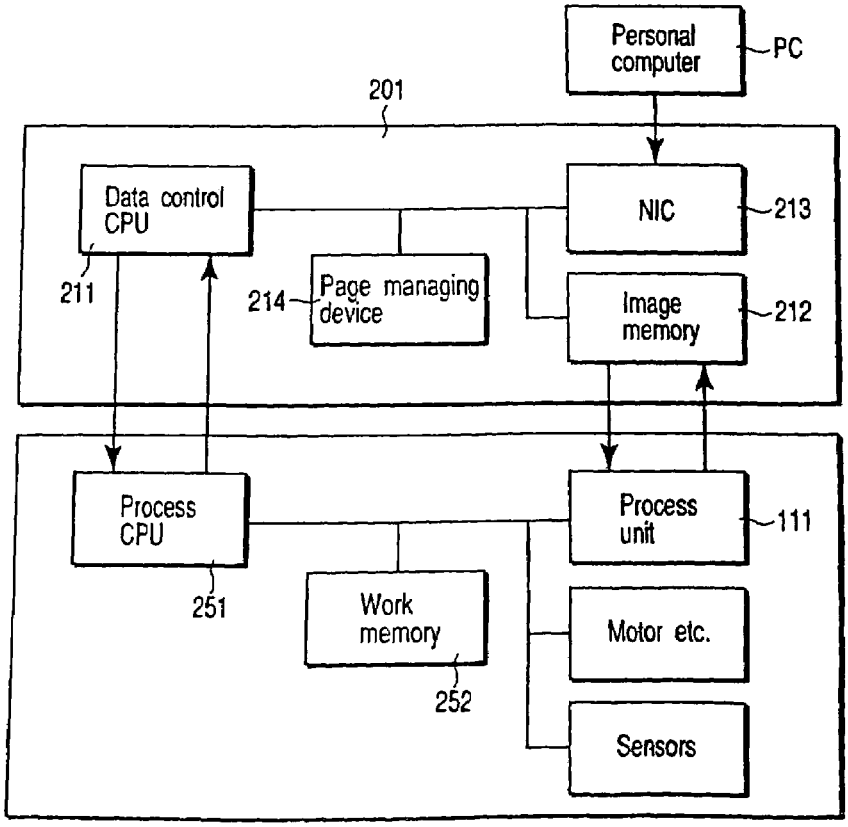
FIG. 2 is a schematic block diagram for explanation of one example of processings of image data in the image forming apparatus shown in FIG. 1.

FIG. 2 is a schematic diagram for explanation of one example of a controlling system which can be applied to the printer apparatus shown in FIG. 1. As shown in FIG. 2, the printer apparatus 1 includes a printer controller 201 controlling the fetching of image data which are used in order for the process unit 111 to output an output image and the output of image data.

The printer controller 201 has a data control CPU 211 compiling the inputted image data into image data (hereinafter, called output-image data in order to be distinguished) which corresponds to an output image corresponding to the latent image which the photosensitive member 112 should hold, and a process CPU 251 controlling operations of the process unit 111.

An image memory 212 storing the output-image data in units of pages, and a network interface 213 for receiving image data supplied from an external apparatus such as a personal computer (PC), and the like are connected to the data control CPU 211.

A page managing device (work memory) 214 managing the number (colors of toner) of the output-image data which is compiled and stored in the image memory 212 and page information, is connected to the data control CPU 211.

A work memory 252 holding the output-image data for one page stored in the image memory 212 as, for example, parallel data in order for the process unit 111 to actually form the image output, is connected to the process CPU 251.

Further, in addition to an unillustrated charging device providing a predetermined electric potential to the photosensitive member 112 of the process unit 111, and the first and second transfer devices 116 and 118, unillustrated various types of elements and drivers or power supply circuits which are necessary for operating these elements, are connected to the process CPU 251.

In addition, a plurality of motors such as, for example, a feed motor for drawing a paper out from the paper cassette 122, a conveying system motor rotating the rollers provided at the paper conveying system 121, a main motor rotating the photosensitive member 112 at a predetermined speed and rotating a belt driving roller 114*a* for moving a predetermined position of the transfer belt 114 at a predetermined speed, a fixing motor rotating the roller 132 of the fixing device 131, or the like are connected to the process unit CPU 251 via a motor driver (not shown).

Moreover, paper pass-through sensors provided at predetermined positions of the conveying system 121 and the fixing unit 131, i.e., an aligning sensor 125 and a fixing/discharging sensor 126, and for example, a plurality of sensors such as temperature sensors sensing the peripheral temperature of the photosensitive member 112 and the temperature of the fixing roller 132 of the fixing device and the like, are connected to the process unit CPU 251 via an input circuit (not shown).

Next, one example of operations of the printer apparatus shown in FIGS. 1 and 2 will be described in detail. Note that the operation which will be described hereinafter is an example of a state in which output images for two pages of an A4 sized paper can be independently overlapped at two areas on the transfer belt at the time of A4 portrait-conveying in which an A4 sized paper is conveyed such that the direction perpendicular to the direction of conveying the paper is the long side of the paper.

The image data corresponding to an image which is to be printed out are supplied in forward order, which is the order from a page whose page number is small to a page whose page number is large, to the printer apparatus 1 via the network interface 213 from an external apparatus, for example, a personal computer PC.

The respective image data include four image data (Y (Yellow), M (Magenta), C (Cyan), and Bk (Black)) corresponding to four (four colors of) monochrome images which are color-separated in order to output a color image in accordance with subtractive primaries.

The image data of four colors inputted into the network interface 213 are compiled on the basis of predetermined rules or limitations by the data control CPU 211, and are stored as output image data in the image memory 212. The image memory 212 can store output image data of an arbitrary number of pages.

The order of the output-image data stored in the image memory 212 is controlled by image processing software (application software). However, if no special limitation is set, it is the order in which the image data are supplied from the external apparatus (the aforementioned forward order).

Namely, generally, the image data are supplied to the image memory 212 in the order of Y image data corresponding to the first page and the second page, M image data corresponding to the first page and the second page, C image data corresponding to the first page and the second page, and Bk image data corresponding to the first page and the second page, Y image data corresponding to the third page and the fourth page, M image data corresponding to the third page and the fourth page, C image data corresponding to the third page and the fourth page, and Bk image data corresponding to the third page and the fourth page, . . . , Y image data corresponding to the n-1 page and the n page, M image data corresponding to the n-1 page and the n page, C image data corresponding to the n-1 page and the n page, and Bk image data corresponding to the n-1 page and the n page.

Figures 3A, 3B, 3C, 3D, 5A, 5B, 5C, 5D:
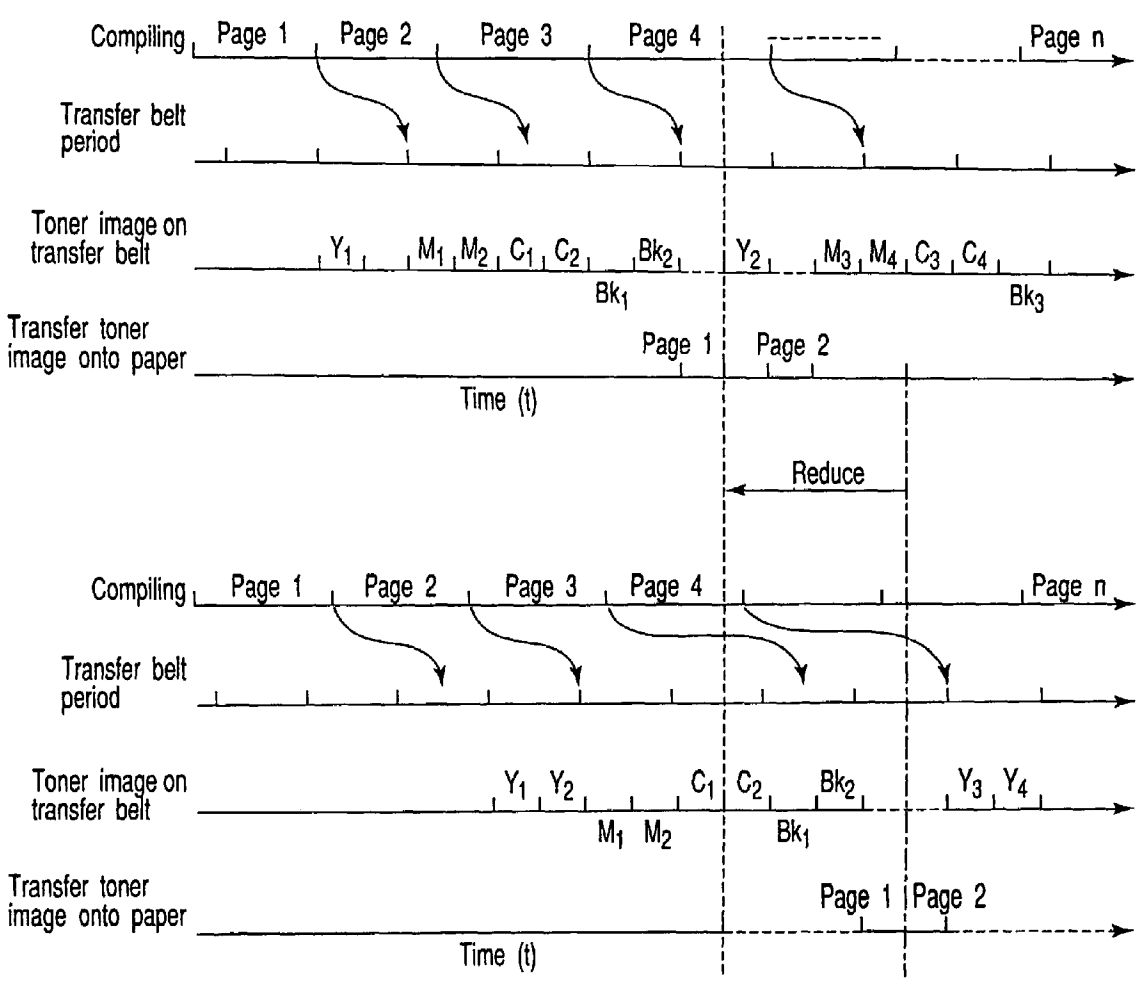
FIGS. 3A to 3D are schematic diagrams for explanation of the order of supplying (compiling) of the image data, the cycle of a transfer belt, the transfer of a toner image to the transfer belt and the timing at which image output is transferred onto an output medium, in the image forming apparatus shown in FIGS. 1 and 2.
FIGS. 5A and 5B are schematic diagrams for explanation of the order of supplying (compiling) of the image data in a well-known image forming apparatus, and the cycle of a transfer belt.
FIGS. 5C and 5D are schematic diagrams for explanation of the transfer of a toner image to the transfer belt and the timing at which image output is transferred onto an output medium, in the well-known image forming apparatus.

At this time, in accordance with complexity of the data such as the density or the size of the image data of the page which is to be outputted, as shown in FIGS. 5A and 5B, there are cases in which compiling of the output-image data of the four colors is delayed as compared with a cycle in which the transfer belt 114 is rotated.

Because the predetermined position of the transfer belt 114 is moved at a constant speed, as shown in FIGS. 3A to 3D, at the point in time when at least the four image data (for four colors) of the first page are stored in the image memory 212, the printing data of the first page can be outputted.

For example, as shown in FIG. 3C, it is supposed that printing data are stored in the image memory 212 in the order of Y image data corresponding to the first page, M image data corresponding to the first page and the second page, C image data corresponding to the first page and the second page, and Bk image data corresponding to the first page and the second page, and Y image data corresponding to the second page.

Under the above-described condition, the start of forming the output image, i.e., a print out instruction, is outputted from the data control CPU 211 to the process unit 251 at the point in time when the Bk image data corresponding to the first page is stored in the image memory 212. In this case, as shown in FIG. 3D, at least a print out corresponding to the output-image data of the four colors corresponding the first page is outputted whether the output-image data corresponding to the second page has been compiled or not.

In further detail, as shown in FIG. 3C, at the point in time when the output-image data of the four colors corresponding to the first page are compiled, a Y latent image of the first page is formed on the photosensitive member 112, is developed at the developing section 113Y, and is transferred as a Y toner image to the transfer belt 114. At this time, a Y toner image corresponding to a Y latent image of the second page should be transferred to a remaining region by the time the transfer belt 114 has moved. However, because the output-image data for the Y image has not been compiled, the Y latent image of the second page and the Y toner image are not formed at this point in time.

Subsequently, in accordance with the timing over which the predetermined position of the transfer belt 114 moves, an M latent image of the first page is formed on the photosensitive member 112, and is developed at the developing section 113M, and is transferred as an M toner image to the transfer belt 114.

Further, an M latent image of the second page is formed on the photosensitive member 112 in the remaining region by the time the predetermined position of the transfer belt 114 has moved, and is developed at the developing section 113M, and is transferred as an M toner image to the transfer belt 114.

Namely, in general printer apparatuses, when toner images for two pages can be formed on the same circle while the predetermined position of the transfer belt moves once, with regard to both of the first page and the second page, the image of the color which has been determined to be transferred first, (in this case) the Y toner image, is firstly formed.

To the contrary, in the present invention, even if toner images of two pages can be formed on the same circle while the predetermined position of the transfer belt moves once at the point in time when the output-image data of the first page of the image of the color determined to be transferred first, i.e., the Y toner image, is compiled, after the latent image of the first page is formed on the photosensitive member 112 and developed, the developed image is transferred as a toner image to the transfer belt 114 whether or not the output-image data of the second page is compiled.

Note that, in the present invention, at the point in time when the data relating to the output corresponding to the M image of the second page is compiled, because the Y toner image which is the Y image of the first page is already transferred to the transfer belt 114, with respect to the second page, the M toner image is firstly transferred to the transfer belt 114.

In this case, because the Y toner image is already transferred to the transfer belt 114, the M toner image of the first page is transferred so as to overlap the Y toner image on the transfer belt 114.

Next, the C images and the Bk images of both of the first page and the second page are formed on the photosensitive member 112, and thereafter, are developed by the developing section in which toners of the colors respectively corresponding to the C images and the Bk images are accommodated, and are transferred as C toner images and Bk toner images to the transfer belt 114. At this time, the output-image data of the first page is data which is superposed in the order of the Y toner image, the M toner image, the C toner image, and the Bk toner image on the transfer belt 114.

On the other hand, the output-image data of the second page is in a state in which the data are superposed in the order of the M toner image, the C toner image, and the Bk toner image on the transfer belt 114. Namely, the output-image data of the second page is in a state in which the Y toner image is missing.

Incidentally, at the point in time when the Bk toner image is transferred on the transfer belt 114, because all of the toner images of the four colors of the output-image data of the first page have been transferred, the toner images are transferred as an output image onto an output medium conveyed through the conveying system 121 to the transfer position at a predetermined timing, at a transfer position at which the transfer belt 114 faces the second transfer device 118.

Further, while the output image of the first page is being transferred onto the output medium, the Y toner image which the Y image data corresponding to the second page is developed is transferred so as to overlap the M toner image, the C toner image, and the Bk toner image which have been already superposed on the transfer belt 114.

Next, at a predetermined timing, the second output medium used for the second page is transferred as the output image of the second page at the transfer position on the output medium conveyed through the conveying system 121.

Note that, at the point in time when the four color toner images corresponding to the second page are transferred on the transfer belt 114, when arbitrary output-image data among the four color output-image data corresponding to the third page is stored in the image memory 212, a toner image newly developed with an arbitrary color is transferred on the region, after the toner images of the four colors corresponding to the output-image data of the first page were already transferred on an output medium, of the effective image holding length of the transfer belt 114.

In this way, toner images, in which latent images formed on the photosensitive member 112 are developed by toners of corresponding colors, are sequentially transferred onto the transfer belt 114, and are transferred as an output image onto an output medium at all times at the point in time when the toner images of the four colors are overlapped on the transfer belt 114. Namely, in accordance with a method in which output images are transferred onto an output medium at all times, because there is no need to delay the transferring onto the output medium until the toner images corresponding to the output-image data for all of the pages have been transferred onto the transfer belt 114, the output efficiency is improved when outputting images in units of one page.

Figure 4:
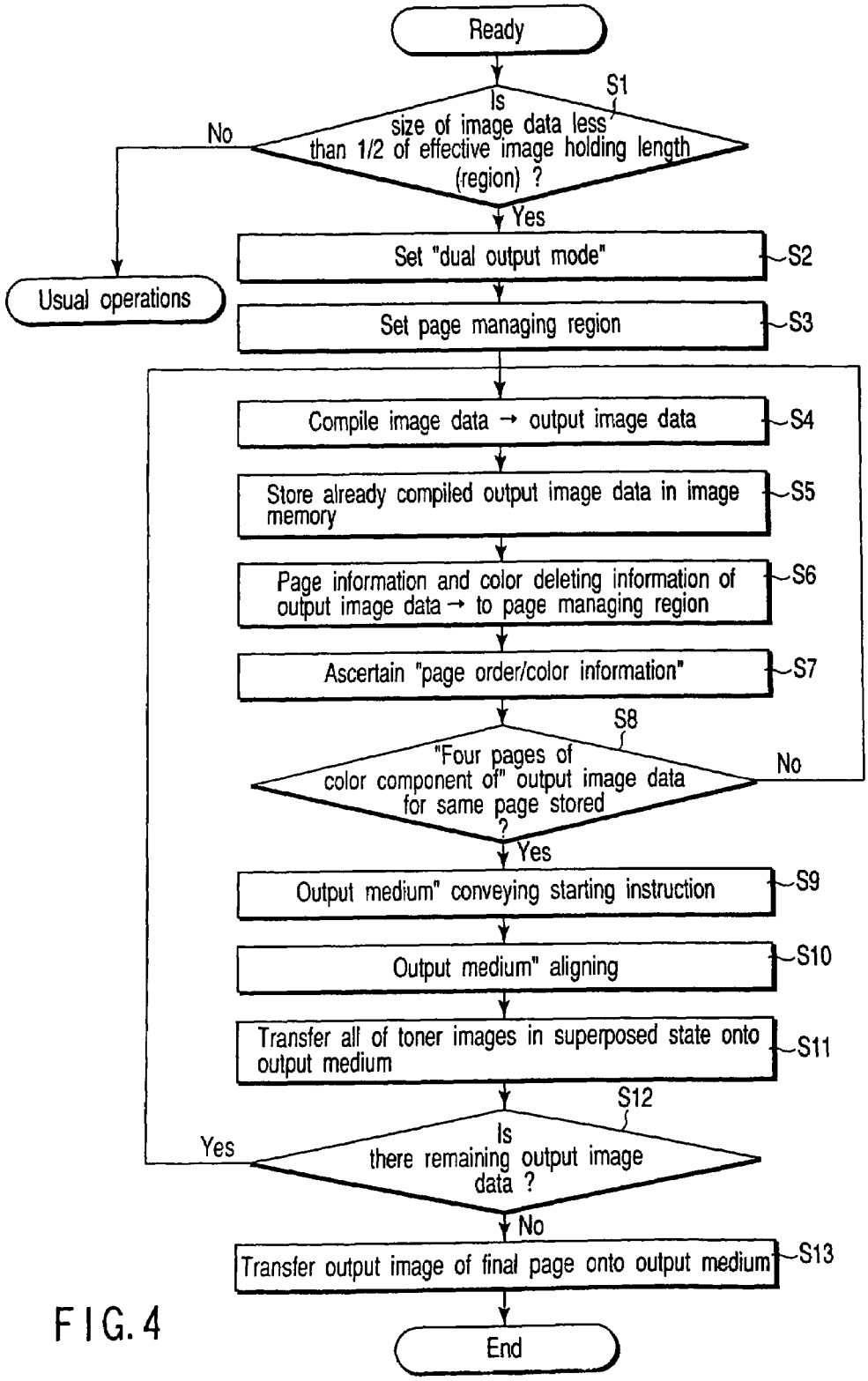
FIG. 4 is flowchart for explanation of one example of the operations of the image forming apparatus explained by using FIGS. 1, 2, and 3A to 3D.

FIG. 4 is a flowchart for detailed explanation of one example of the operations of the printer controller and the page managing device described above.

As shown in FIG. 4, when the printing process starts, it is determined whether or not the size of the image data inputted via the data control CPU 211 is less than or equal to ½ of the effective image holding length of the transfer belt 114 (S1).

When the inputted image data is image data which is greater than ½ of the effective image holding length (S1—No), the usual printing process is executed.

When the size of the inputted image data is less than or equal to ½ of the effective image holding length (S1—Yes), toner images corresponding to the output-image data for two pages are held in the range of the effective image holding length in the page managing device 214. At the point in time when the output-image data for one page is stored in the image memory 212, a "dual output mode" in which the toner images are transferred onto an output medium in units of one page is set (S2).

When the "dual output mode" is set, a page managing region checking that the output-image data of two pages× four colors are stored in the image memory 212 is set in an arbitrary rewritable memory (RAM), for example, the image memory 212, by the control of the page managing device 214 (S3).

Hereinafter, the image data inputted by the data control CPU 211 are sequentially compiled into the output-image data (S4), and are sequentially stored in the image memory 212 (S5).

At the same time, or at a predetermined timing, it is instructed (inputted), to a page managing region which has been dimensioned, that the output-image data stored in (transmitted to) the image memory 212 is output-image data corresponding to a toner image of a certain page and color (S6).

Accordingly, information relating to the colors of the toners corresponding to the order of the pages corresponding to the output data stored in the image memory 212 are held at the page managing region (S7).

Hereinafter, by repeating steps S4 and S5, and S6 and S7, the information relating to the colors of the toners corresponding to the order of the pages are accumulated at the page managing region, and it is determined whether or not the output images of four colors per one page, which enable transfer of the output image onto an output medium, are stored (S8).

Further, a timing instruction for operating the driving section, such as the feed motor which is not described in detail or the like of the conveying system 121, which conveys an output medium on the path 123 to the transfer position, is outputted toward the process CPU 251 (S9), for example, after a predetermined time has passed from the time when the first image data was supplied to the data control CPU 211. In accordance therewith, one output medium is conveyed to the aligning roller 124. Namely, by a medium conveying instruction from the data control CPU 211 (printer controller 201), the output medium is prepared such that the output medium can be conveyed to the transfer position (S10).

At step S8, it is sensed that the output-image data of four colors which can output the output image of the first page are held, and at step S10, the output medium is aligned by the aligning roller 124. Next, the rotation of the aligning roller 124 and the applying of transfer voltage from the power-supply unit 119 to the transfer device 118 are instructed to the process CPU 251, and the output image of the first page, on which the toner images of the four colors conveyed accompanying the rotation of the transfer belt 114 at a predetermined timing are overlapped, is transferred onto an output medium (S11).

Hereinafter, it is sensed whether or not the image data corresponding to the remaining pages are stored in the image memory 212 (S12). When the image data are stored in the image memory 212 (S12—Yes), by repeating steps S4 and S5, and S6 and S7, information relating to the colors of the toners corresponding to the order of the pages are accumulated at the page managing region, and the printing process is continued.

Further, when the image data are not stored in the image memory 212 (S12—No), the output medium holding the output image of the final page is fed, and the output image is transferred at the transfer position (on the output medium), and the series of printing processes is completed (S13).

As described above, in accordance with the present invention, in a printer apparatus using an intermediate transfer medium, when images of two pages are formed on an effective image holding length of the intermediate transfer medium and transferred onto an output medium, because the image of the page is transferred onto the transfer medium and outputted at the point in time when the output-image data of the one page has been obtained, the outputting speed relating to the image output of the unit of one page can be improved.

Note that the above-described embodiment describes an example of a page printer forming a latent image on a drum-shaped photosensitive member by using a transfer belt as an intermediate transfer medium. However, it goes without saying that the intermediate transfer medium may be drum-shaped, and the photosensitive member on which a latent image is formed may be belt-shaped, or they may be a combination of arbitrary shapes. Further, it goes without saying that the present invention can be used for a serial printer, a copier, a facsimile apparatus, or a multifunction copier in which the plurality types of such devices are integrated, or the like.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for forming a color image in which a number of color toner images are superposed together by using an intermediate transfer medium, comprising:

forming a plurality of electrostatic images corresponding to image data;

developing each of electrostatic images by supplying toner of a predetermined color to said each electrostatic image;

successively transferring toner images having different colors onto a predetermined position on an intermediate transfer medium, and holding the toner images, on one of effective image holding regions of the intermediate transfer medium, after at the point in time when output-image data on a first color, which corresponds to one of the effective image holding regions are compiled, an electrostatic image for said one of the effective image holding regions is formed on the image forming section, is developed at the developing section, and is transferred as a toner image to the toner image holding section, and when the output-image data for the electrostatic image for the other effective image holding region is not compiled, at the point in time when output-image data on a second color, which corresponding to said one of the effective image holding regions, are complied, an electrostatic image for said one of the effective image holding regions is formed on the image forming section, is developed at the developing section, and is transferred as a toner image of a second color to the toner image holding section; and transferring the toner images from the intermediate transfer medium to a transfer medium such that the toner images are superposed on each other on the transfer medium.

2. An image forming apparatus which superposes toner images of a predetermined number of colors by using an intermediate transfer medium, and which obtains a color image output by collectively transferring the toner images onto a transfer medium, comprising:

means for forming an electrostatic image that is the basis of a toner image corresponding to image data;

means for developing the electrostatic image formed at the forming means, and supplying toner to the electrostatic image to form the toner image;

means for holding the toner image formed at the developing means, the holding means having two effective image holding regions of a predetermined size, each of the effective image holding regions being capable of holding toner images, with the toner images superposed on together;

means for transferring the toner image held by the holding means onto a transfer medium; and first control means for performing a control for causing the transferring means to transfer said at least one toner image for the transfer medium, which is held by the holding means, to the transfer medium, when said at least one toner image is transferable onto the transfer medium, and for performing a control for keeping color of the toner to be supplied from the developing means to the electrostatic image unchanged until the holding means makes one round.

3. The image forming apparatus according to claim 2, further comprises:

second control means for determining whether or not said at least one toner image held by the holding means is transferable to the transfer medium, and for permitting the first control means to perform the controls, when determining that said at least one toner image held by the holding means is transferable to the transfer medium.

4. The image forming apparatus according to claim 3, wherein at the point in time when output-image data on a first color, which corresponds to one of the effective image holding regions are compiled, the second control means causes an electrostatic image for said one of the effective image holding regions to be formed on the forming means, to be developed at the developing means, and to be transferred as a toner image to the holding means, and when the output-image data for the electrostatic image for the other effective image holding region is not compiled, at the point in time when output-image data on a second color, which corresponding to said one of the effective image holding regions, are complied, the second control means causes an electrostatic image for said one of the effective image holding regions to be formed on the forming means, to be developed at the developing means, and to be transferred as a toner image of a second color to the holding means.

5. An image forming apparatus which overlaps toner images of a plurality of colors by using an intermediate transfer medium, and which obtains a color image output by collectively transferring the toner images onto a transfer medium, comprising:

an image forming section which can hold an electrostatic image that is the basis of a toner image corresponding to image data;

a developing section which supplies toner to the electrostatic image formed at the image forming section so as to make the electrostatic image visible, and which forms the toner image;

a toner image holding section which holds the toner image formed at the developing section, the toner image holding section being capable of holding two or more toner images in a superposed state, having two effective image holding regions of a predetermined size, and being capable of holding toner images for different transfer media in the respective effective image holding regions;

a transfer outputting section which transfers the toner images held by the toner image holding section onto a transfer medium;

a transfer control section which moves the transfer medium to a transfer position at which the toner image is transferable onto the transfer medium between the toner image holding section and the transfer outputting section, when a page managing section provides information indicating that at least one toner image, for the transfer medium held by the toner image holding section, is transferable onto the transfer medium; and wherein during transfer of the toner images, at least one toner image for another transfer medium is held by the toner image holding section in the effective image holding regions at an area for said at least one toner image, and while transferring the toner images held by the toner image holding section onto the transfer medium, an arbitrary number of toner images are held by the toner image holding section in the area for said at least one toner image.

* * * * *